US005671629A

United States Patent [19]

Valyi

[11] Patent Number: 5,671,629

[45] Date of Patent: Sep. 30, 1997

[54] HYDROSTATIC FORMING DEVICE AND PROCESS

[76] Inventor: Emery I. Valyi, 102 Moseman Ave., Katonah, N.Y. 10536

[21] Appl. No.: 602,075

[22] Filed: Feb. 15, 1996

[51] Int. Cl.[6] ..... B21D 26/02; B21D 39/08

[52] U.S. Cl. ..... 72/58; 72/62; 72/63

[58] Field of Search ..... 72/54, 56, 58, 72/60, 61, 62, 63

[56] References Cited

U.S. PATENT DOCUMENTS

| | | | |
|---|---|---|---|
| 2,168,641 | 8/1939 | Arbogast | 72/58 |
| 3,358,487 | 12/1967 | Brejcha et al. | 72/56 |
| 3,394,569 | 7/1968 | Smith | 72/62 |
| 3,529,458 | 9/1970 | Butler et al. | 72/60 |
| 3,857,265 | 12/1974 | Howeler et al. | 72/56 |
| 4,437,326 | 3/1984 | Carlson | 72/62 |
| 5,085,068 | 2/1992 | Rhoades et al. | 72/54 |

*Primary Examiner*—David Jones
*Attorney, Agent, or Firm*—Bachman & LaPointe, P.C.

[57] ABSTRACT

A device and process for hydrostatic forming is disclosed. The device for hydrostatically forming an article comprises an expandable bladder for shaping the article; a fluid for expanding the bladder; and a device for moving the fluid into the bladder for expanding the same. The fluid is heated prior to being moved into the bladder for raising the temperature of the article and lowering the yield strength of the article, thereby increasing the formability of the article.

19 Claims, 2 Drawing Sheets

HYDROSTATIC FORMING DEVICE AND PROCESS

BACKGROUND OF THE INVENTION

The invention is directed to hydrostatic forming, and more particularly, to an improved device and process for more efficiently hydrostatically forming articles such as metal cans.

Hydrostatic forming is a method wherein fluid under pressure is used to shape a material such as metal, plastic, and glass into a differently shaped article. Typically, glass and plastic hollow articles are blown or hydrostatically formed with air as the forming fluid. Hollow metal articles having a narrow opening are similarly formed using water at high pressure. Frequently, the forming fluid is encapsulated in a closed flexible container formed from an elastomer, such as a bladder. That is, instead of filling the article to be shaped directly with the fluid, the bladder is inserted into the article and pressure within the bladder is increased by known means with the shaping fluid, thereby expanding both the bladder and the article.

A bladder is preferably used since it does not require the article to be directly filled with or drained of the fluid. Accordingly, the bladder is preferable because there is no interaction between the forming fluid and the material comprising the article that is to be formed. However, this technique has some inherent disadvantages. For example, the processes and devices which currently use the bladder technique are generally slow compared to the typical mechanical forming techniques. For that reason, recently metal cans, particularly aluminum cans, have been made in known ways and then post-formed by the internal application of mechanical means, such as expandable tools, for forming the cans into shapes that are not cylindrical.

FIG. 3 shows a simplified view of a process and device known in the prior art, which uses a bladder as described above. An article 1, shown unexpanded and expanded by dotted lines, for this example, a metal cylinder, is placed in a mold 2. A bladder 3 made of rubber is filled with fluid, which fluid has a volume equal to that of the cylinder after it is shaped according to mold cavity 5. Through a valve 4, a pressure means is connected to bladder 3. The bladder is inserted into the can 1 in the unexpanded state and once insertion is complete, the forming fluid, in this case water, is forced under pressure into bladder 3 causing the bladder to expand. The expanding bladder exerts pressure against the inside wall of the cylinder, conforming it to the mold cavity 5 of mold 2. The sequence of arranging the bladder inside the cylinder, may be carried out in several ways. For example, the cylinder may be slipped over the bladder and then both placed together into the mold. Other sequences may be used, such as placing the cylinder into the mold first and then moving the bladder by some means into the cylinder while fixed in the mold. In either case, after forming, the pressurized forming fluid is released from the bladder and the bladder is extracted from the cylinder. The mold is then opened and the shaped cylinder is removed from the mold. These steps, again, may be taken in any convenient sequence.

In this prior art process, the extent of forming of the metal cylinder, such as a can, is substantially limited by the amount of deformation the metal of the can is able to sustain without fracture, the length of time during which forming pressure via the forming fluid is applied, and the temperature of the metal during forming. The rate at which pressure is applied is another parameter which must be considered. At extreme rates, the pressure acts as an impact load, causing fracture. Deformation of the metal, or any other material, is accomplished by imparting the amount of energy which is necessary to attenuate and ultimately sever the structural bonds that characterize the morphology of the material. This energy may be kinetic, thermal or mechanical. Accordingly, under a certain force or pressure, the can will deform faster as the temperature of the can is increased and/or the faster energy is transferred.

There exists a need, therefore, for a hydrostatic forming process and device for shaping articles more efficiently than permitted by the prior art processes and devices, through increasing the rate and amount of deformation and, if necessary, by increasing the temperature of the forming fluid and as a result, the temperature of the can.

SUMMARY OF THE INVENTION

The primary object of this invention is to provide a device and process for hydrostatically forming articles more efficiently than with currently known techniques.

Another object of this invention is to provide a device and process for hydrostatically forming an article, which device and process uses a bladder and a forming fluid which may be readily heated, and which allows for faster expansion of and accordingly, faster forming of, the article.

Still another object of this invention is to provide a device and process for hydrostatically forming an article which device and process uses a bladder expandable by an incompressible fluid in the article, wherein the incompressible fluid may be heated during expansion.

Still another object of this invention is to provide a device and process for hydrostatically forming an article wherein a forming fluid thereof is heated while expanding a bladder in the article for increasing the rate at which the article may expand.

The objects and advantages disclosed herein are achieved by the device and process of the present invention for hydrostatic forming. The device for hydrostatically forming an article comprises a means for shaping the article; fluid means for expanding the means for shaping; and means for moving the fluid means for expanding in the means for shaping, wherein the means for expanding may be heated prior to being moved in the means for shaping for raising the temperature of the article and increasing formability of the article.

A process in accordance with the principles of the present invention comprises the steps of placing the article in a mold; inserting an expandable bladder containing an incompressible fluid into the article; heating an incompressible fluid; and expanding the bladder in the article via the incompressible fluid for conforming the article to the mold, the incompressible fluid preferably being a good heat conductor.

The details of the present invention are set out in the following description and drawings wherein like reference characters depict like elements.

DETAILED DESCRIPTION OF THE PREFERRED EMBODIMENT

Figure 2B:
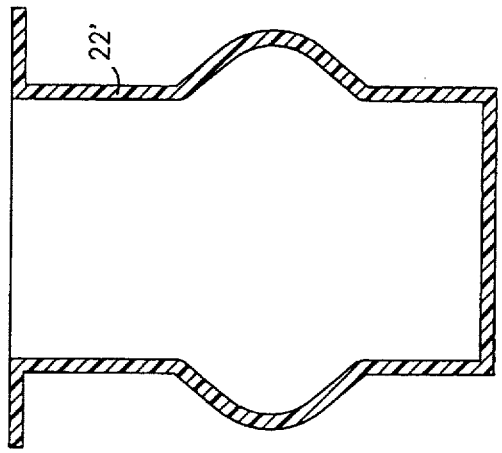
FIG. 2B is an elevational and cross-sectional view of the article of FIG. 2A after formed via hydrostatic forming.
Figure 2A:
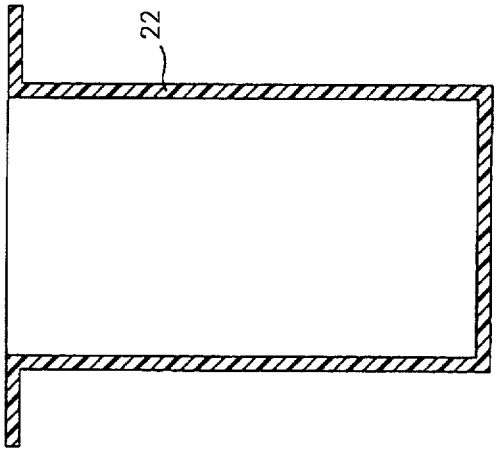
FIG. 2A is an elevational and cross-sectional view of an article to be formed by hydrostatic forming.
Figure 1:
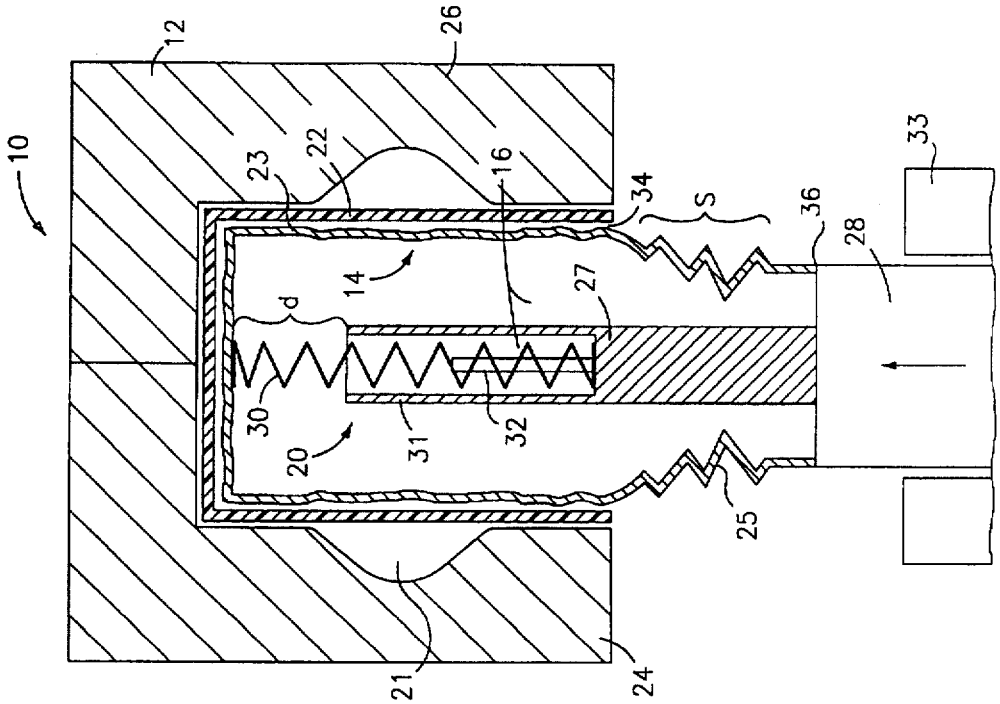
FIG. 1 is an elevational and partially cross-sectional schematic view of the device of the present invention used for hydrostatically forming the article shown in FIG. 2A into the article shown in FIG. 2B.
Figure 3:
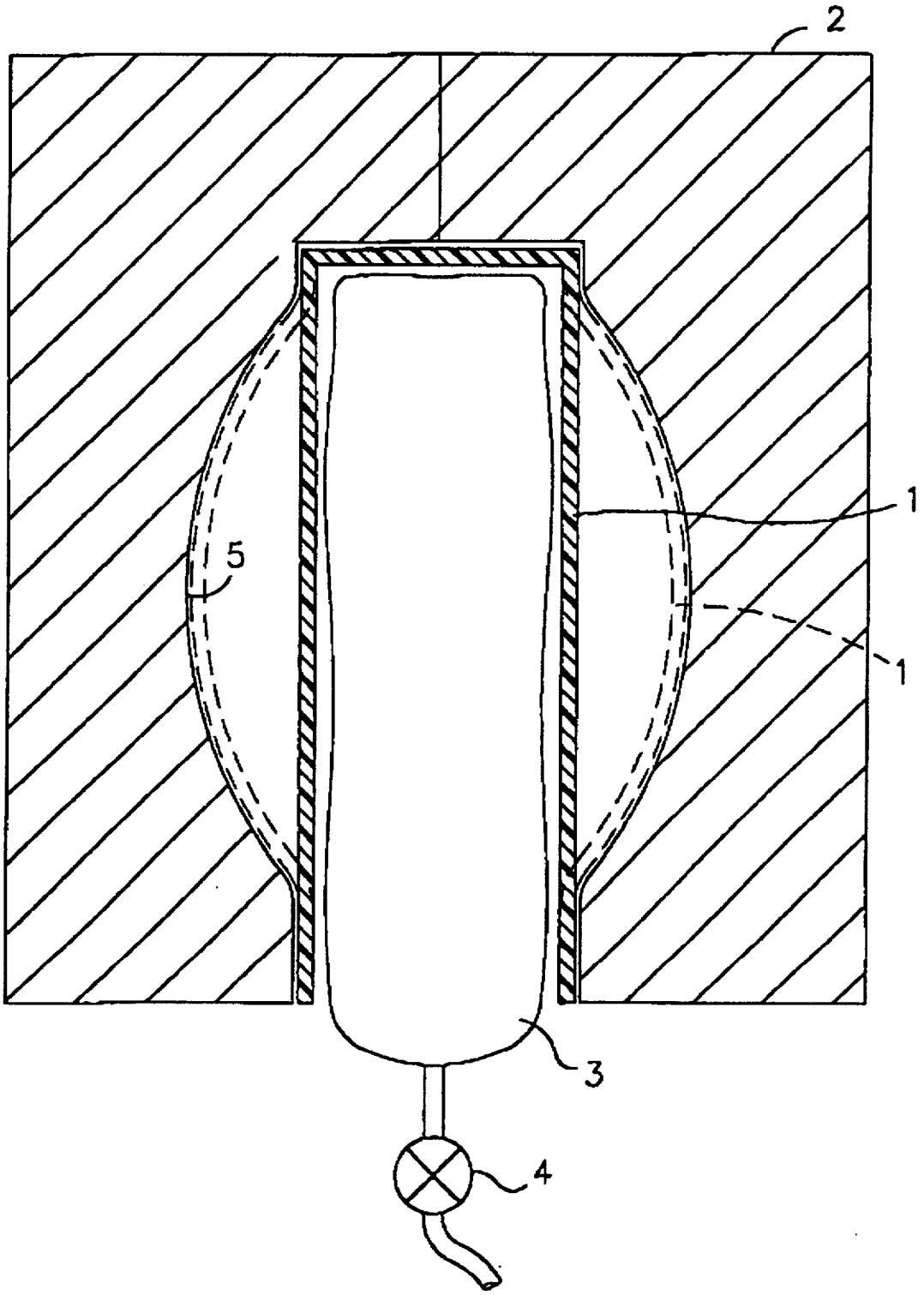
FIG. 3 (PRIOR ART)
FIG. 3 is a schematic view of a prior art process used for hydrostatically forming an article.

Referring now to the drawings in detail, there is shown in FIG. 1 an elevational schematic view of the device of the present invention, designated generally as 10, used for hydrostatically forming an article shown in FIG. 2A into the article shown in FIG. 2B. The device 10 generally includes a mold 12, a bladder 14, fluid 16, and a spring assembly 20.

Referring to FIGS. 1, 2A and 2B, mold 12 has a cavity 21 in which an article 22 is to be formed into article 22'. Accordingly, cavity 21 preferably corresponds to the shape shown in FIG. 2B for forming article 22 into that shape, although other shapes can be used. Mold 12 preferably includes a first mold half 24 and a second mold half 26. Article 22 is, for the purpose of this discussion, a metal can, and preferably an aluminum metal can, which is to be placed into mold 12 by any desirable means known in the art. Other articles, made of other materials, of course, may be formed by the device and process discussed herein and accordingly, the scope of the invention is not intended to be limited to for use with a metal can. Article or can 22 preferably has a cylindrical shape with its outwardly facing end open for the insertion of device 10 for expanding the can into the shape of the cavity or impression 21 of mold 12.

The main functional or forming portion of device 10 includes bladder 14, fluid 16 and spring assembly 20.

Bladder 14 is sealed and includes an elastomeric, expandable portion 23 and a bellows portion 25. The bladder is formed from a material capable of sufficient elastic deformation for being expanded by fluid 16 under pressure, which pressure is provided from fluid 16 movable from bellows portion 25 of bladder 14 through expandable upper portion 23, for shaping can 22 into the impression of mold 12. Bellows portion 25 is sufficient in volume for holding an amount of fluid 16, in combination with an amount of fluid 16 also held in expandable portion 23, for expanding expandable portion 23 under the force of fluid 16 moved therein.

Fluid 16 is an incompressible fluid, such as an incompressible liquid, and preferably a metal of low melting point, e.g. Wood's metal, for obtaining rapid force transfer approximating that of a solid substance, for causing expansion of bladder 14. Preferably, water is not used so as to avoid sealing problems which may be associated with its use. The incompressible fluid used preferably has a melting point substantially close to room temperature. Initially, fluid 16 is located in both bellows portion 25 and expandable portion 23.

Fluid 16 is moved out of bellows portion 25 into the expandable portion 23 of bladder 14 via punch 28, as punch 28 is moved by conventional means in the direction of the arrow shown in FIG. 1. That is, as punch 28 is moved in the direction of the arrow, bellows portion 25 is caused to compress, lessening the volume of bladder 14 and moving fluid 16 into expandable portion 23. Bladder 14 as a whole, including expandable portion 23 and bellows portion 25, is designed to carry an operative amount of fluid 16. That is, while bellows portion 25 is in the uncompressed state, an amount of fluid is carried which is sufficient to cause expandable portion 23 to expand to fill the mold cavity, thereby expanding the walls of article or can 22 into mold cavity 21, when bellows portion 25 is moved via punch 28 into the compressed state. While bladder 14 is both expanded and unexpanded, a spring 30 of spring assembly 20 is operative to maintain bladder 14 in a substantially longitudinally rigid state, allowing for movement of bladder 14 into and out of the mold cavity. To provide support to spring 30, sleeve 31 is preferably used in which spring 30 is compressible. Sleeve 31 extends from punch 28 into bladder 14 and has a length such that spring 30 extends unsupported out of sleeve 31 a distance equal to or greater than the stroke of bellows portion 25 so that bladder 14 remains supported at all times. Accordingly, with reference to FIG. 1, distance "d" is greater than or equal to stroke "s" of bellows portion 25.

To facilitate more efficient forming through increased formability of the can, incompressible fluid 16 is preferably heated in bladder 14 via heater 32. Heater 32 may be a cartridge heater sealed within bladder 14 and attached to punch 28, and is located preferably in sleeve 31. Accordingly, fluid 16 expanding bladder 14 heats the metal of can 22 through the wall of bladder 14 to facilitate the expansion of can 22.

Entire device 10 is movable into and out of the mold cavity of mold 12 via a mechanism 33 of known form (shown schematically) attached to punch 28 for reciprocating punch 28. Accordingly, device 10 is moved in a reciprocal manner into and out of cavity 34 of can 22 for placing the bladder 14 in position for expanding can 22 into the mold cavity or impression 21 defined by mold halves 24 and 26.

Accordingly, after forming is complete, mechanism 33 is operative to move device 10 out of can 22 for use with the next can to be formed. End 36 of bellows portion 25 is sealed to punch 28 by known means.

In operation, can 22 is placed between mold halves 24 and 26 of mold 12 and mold halves 24 and 26 are clamped shut. Device 10 is moved into cavity 34 of can 22 while can 22 is positioned in mold 12, via punch 28. Once positioned in cavity 34 of can 22, incompressible fluid 16, sufficient in volume for expanding bladder 14 into the shape of mold 12, is moved via the bellows portion 25 of the bladder substantially entirely into expandable portion 23. The incompressible fluid is heated via heater 32. Fluid 16 is operative via the compression of bellows portion 25 to expand expandable portion 23 of bladder 14 adjacent the walls of can 22 into the mold cavity or impression 21 formed by the mold cavity defined by first mold half 24 and second mold half 26.

Since the incompressible fluid 16 is heated during expansion of the walls of can 22, the walls are rendered deformable. That is, since more rapid energy transfer is achieved due to the more heated fluid, can 22 is caused to deform more readily. Accordingly, the walls of can 22 are formed into the shape of the mold cavity via the force of pressurized fluid 16 in bladder 14. Once the can is properly formed, pressure by incompressible fluid 16 in bladder 14 is released by allowing the bellows portion 25 of bladder 14 to decompress, thereby returning bladder 14 to its unexpanded state. Mechanism 33 is then operable to move device 10 out of the mold 12 for subsequent stripping of the molded can therefrom.

The primary advantage of this invention is that a device and process is provided for hydrostatically forming articles more efficiently than with currently known techniques. Another advantage of this invention is that a device and process for hydrostatically forming an article is provided, which device and process uses a bladder and an incompressible forming fluid which may be readily heated and which allows for more and faster expansion of, and accordingly, faster forming of, the article. Still another advantage of this invention is that a device and process for hydrostatically forming an article is provided which device and process uses a bladder, expandable by an incompressible fluid in the article, wherein the incompressible fluid may be heated during expansion. Still another advantage of this invention is that a device and process for hydrostatically forming an article is provided wherein a forming fluid thereof is heated while expanding a bladder in the article for increasing the rate at which the article may expand.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A device for hydrostatically forming an article, comprising:

a means for shaping said article;

fluid means for expanding said means for shaping; and means for moving said fluid means for expanding in said means for shaping for expanding said means for shaping, wherein said means for expanding is heated prior to being moved in said means for shaping for raising the temperature and increasing the formability of said article, and wherein said fluid means for expanding comprises solely an incompressible fluid.

2. The device according to claim 1, wherein said incompressible fluid has a melting point substantially close to room temperature.

3. The device according to claim 2, wherein said incompressible fluid is a molten metal.

4. The device according to claim 1, further including a heater for heating said incompressible fluid for raising the temperature of said article for further facilitating the shaping of said article.

5. The device according to claim 1, further including mold halves forming a mold cavity having a shape and means for positioning said means for shaping and said means for expanding in said mold cavity for allowing the shaping of said article into said shape of said mold cavity via said means for shaping.

6. The device according to claim 1, wherein said article is a metal can.

7. A process for hydrostatically shaping an article, comprising the steps of:

placing said article in a mold;

inserting an expandable bladder into said article;

heating an incompressible fluid;

moving said incompressible fluid into said bladder for expanding said bladder in said article;

heating said article via said incompressible fluid; and conforming said article to said mold under force provided by said expanding bladder and incompressible fluid, including the step of expanding said bladder to conform said article to said mold solely by said incompressible fluid.

8. The process according to claim 7, wherein said article comprises a metal can.

9. The process according to claim 7, wherein said incompressible fluid is a molten metal.

10. The process according to claim 9, wherein said molten metal is derived from a metal having a melting temperature close to room temperature.

11. The process according to claim 7, wherein said step of inserting is performed via a means for moving said bladder and said incompressible fluid into said article.

12. A device for hydrostatically forming an article comprising:

a means for shaping said article;

fluid means for expanding said means for shaping, wherein said means for expanding is a molten metal having a melting point close to room temperature and wherein said molten metal is Wood's metal; and means for moving said fluid means for expanding in said means for shaping for expanding said means for shaping, wherein said means for expanding is heated prior to being moved in said means for shaping for raising the temperature and increasing the formability of said article.

13. A device for hydrostatically forming an article, comprising:

a means for shaping said article;

fluid means for expanding said means for shaping;

means for moving said fluid means for expanding in said means for shaping for expanding said means for shaping, wherein said means for expanding is heated prior to being moved in said means for shaping for raising the temperature and increasing the formability of said article;

said means for shaping comprising a bladder;

said fluid means for expanding comprising an incompressible fluid;

said means for moving comprising a bellows attached with said bladder;

a heater for heating said incompressible fluid while in said bladder;

a mold; and a means for positioning said bladder and fluid in said mold, wherein for shaping said article, said bladder is positioned in said mold, said incompressible fluid is heated and for raising the temperature of said article and said fluid is moved via said bellows expanding said bladder against an interior surface of said article and into conformance with said mold.

14. The device according to claim 13, further including means for supporting said bladder in a longitudinally rigid state.

15. The device according to claim 14, wherein said means for supporting comprises a spring positioned in and against said bladder.

16. A device for hydrostatically forming an article, comprising:

a means for shaping said article;

fluid means for expanding said means for shaping; and means for moving said fluid means for expanding in said means for shaping for expanding said means for shaping, wherein said means for expanding is heated prior to being moved in said means for shaping for raising the temperature and increasing the formability of said article, further including mold halves defining a shape, wherein said means for moving comprises a bellows, said means for expanding comprises an incompressible fluid, and said means for shaping comprises a bladder, and wherein said bellows moves a volume of said fluid into said bladder while positioned between said mold halves sufficient for expanding said bladder and shaping said article into said shape.

17. The device according to claim 16, wherein said bellows portion has an uncompressed and a compressed position, and wherein in combination, fluid in said bellows portion and in said bladder has a volume sufficient for expanding said bladder when said bellows is moved into said compressed position.

18. A process for hydrostatically shaping an article, comprising the steps of:

placing said article in a mold;

inserting an expandable bladder into said article;

heating an incompressible fluid;

moving said incompressible fluid into said bladder for expanding said bladder in said article;

heating said article via said incompressible fluid; and conforming said article to said mold under force provided by said expanding bladder and incompressible fluid, wherein said step of moving is performed via a bellows compressible toward said bladder.

19. The process according to claim 18, wherein said step of heating is performed via a heater positioned in a sleeve in said bladder.

* * * * *